US012740641B2

(12) United States Patent
Graf et al.

(10) Patent No.: US 12,740,641 B2
(45) Date of Patent: Sep. 22, 2026

(54) DIVIDING-UP DEVICE AND BRUSH-MANUFACTURING MACHINE HAVING A DIVIDING-UP DEVICE

(71) Applicant: Zahoransky AG, Todtnau (DE)

(72) Inventors: Christian Graf, Kirchzarten (DE); Benedikt Renz, Schönau (DE)

(73) Assignee: Zahoransky AG, Todtnau (DE)

( * ) Notice: Subject to any disclaimer, the term of this patent is extended or adjusted under 35 U.S.C. 154(b) by 257 days.

(21) Appl. No.: 18/569,662

(22) PCT Filed: Mar. 29, 2022

(86) PCT No.: PCT/EP2022/058329

§ 371 (c)(1),
(2) Date: Dec. 13, 2023

(87) PCT Pub. No.: WO2023/280450

PCT Pub. Date: Jan. 12, 2023

(65) Prior Publication Data

US 2024/0285064 A1 Aug. 29, 2024

(30) Foreign Application Priority Data

Jul. 9, 2021 (DE) ..... 10 2021 117 793.6

(51) Int. Cl.

| | |
|---|---|
| ***A46D 3/04*** | (2006.01) |
| ***A46D 1/04*** | (2006.01) |
| ***A46D 3/08*** | (2006.01) |

(52) U.S. Cl.
CPC ..... *A46D 3/04* (2013.01); *A46D 1/04* (2013.01); *A46D 3/082* (2013.01)

(58) Field of Classification Search
CPC . A46D 1/08; A46D 3/082; A46D 3/08; A46D 3/085
See application file for complete search history.

(56) References Cited

U.S. PATENT DOCUMENTS

| | | | | |
|---|---|---|---|---|
| 2006/0087170 | A1 | 4/2006 | Boucherie | |
| 2021/0330069 | A1 * | 10/2021 | Fritz | A46D 1/08 |

FOREIGN PATENT DOCUMENTS

| | | | | |
|---|---|---|---|---|
| CN | 208243162 | U | 12/2018 | |
| CN | 112410851 | A | 2/2021 | |
| CN | 109561759 | B | 6/2021 | |
| DE | 4040297 | C2 | 6/1992 | |
| DE | 202004016409 | U1 | 2/2005 | |
| DE | 102016004927 | A1 * | 10/2017 | A46D 1/08 |
| DE | 102016012148 | B4 | 1/2026 | |
| WO | 2015185721 | A1 | 12/2015 | |

* cited by examiner

*Primary Examiner* — Shay Karls
(74) *Attorney, Agent, or Firm* — Volpe Koenig

(57) ABSTRACT

Improvements in the technical field of brush manufacture are provided by a dividing-up device (1), which includes a dividing-up disc (5) with at least two dividing-up indents (6) formed at its circumference. In order for it to be possible to adapt an effective indent volume of the dividing-up indents (6) as desired, the dividing-up device (1) also includes an adjusting device (8), which is designed to adjust the effective indent volume of the dividing-up indents (6) that is available for dividing up clusters (2) of bristles.

16 Claims, 7 Drawing Sheets

DIVIDING-UP DEVICE AND BRUSH-MANUFACTURING MACHINE HAVING A DIVIDING-UP DEVICE

CROSS-REFERENCE TO RELATED APPLICATIONS

This application is a 371 National Phase of PCT/EP2022/058329, filed Mar. 29, 2022, which claims priority to German Patent Application No. 10 2021 117 793.6, filed Jul. 9, 2021, both of which are incorporated herein by reference as if fully set forth.

TECHNICAL FIELD

The invention relates to a dividing-up device for dividing up clusters of bristles from a bristle supply, wherein the dividing-up device has a bristle magazine for receiving a bristle supply and a dividing-up disc, which has on its circumference at least two dividing-up indents and can be moved with its at least two dividing-up indents past a removal opening of the bristle magazine for dividing up clusters of bristles from a bristle supply in the bristle magazine. Furthermore, the invention also relates to a brush-manufacturing machine having at least one such dividing-up device.

BACKGROUND

Dividing-up devices of the type mentioned at the outset are already known in practice in different embodiments. They are used to divide up clusters of bristles from a supply of loose bristle filaments and to provide these for the further processing for the manufacture of brushes, in particular of toothbrushes.

Here, the so-called effective indent volume of the at least two dividing-up indents of the dividing-up disc of the dividing-up device determines how many individual bristle filaments, in each case, can be divided up using the dividing-up indents from the supply of loose bristle filaments in a cluster of bristles.

Depending on the field of application the number of individual bristle filaments in a cluster of bristles divided up or picked from the bristle supply has a larger or smaller large tolerance range. A large tolerance range can, for example, provide that a cluster of bristles meets the requirements if it comprises 20+/−5 bristle filaments. A small tolerance range can provide that the cluster of bristles only then can be classified as being in order if the cluster of bristles comprises 20+/−1 individual bristle filaments.

When designing the dividing-up discs and their dividing-up indents, empirical values are used as a basis in order to determine the size of the dividing-up indents of the dividing-up discs. However, this determination is not always sufficiently precise, to meet the requirements regarding the number of bristle filaments within a divided-up cluster of bristles. For example, it may be necessary to rework or re-manufacture the dividing-up discs if clusters of bristles divided up using the dividing-up discs do not meet the requirements. Factors which influence the number of individual bristle filaments within clusters of bristles which are picked with a dividing-up indent, can be, for example, the structure of the individual bristle filaments, the material of which the bristle filaments are made, and material properties of the bristle filaments, such as their elasticity. Further influencing factors can be temperature, air pressure or also humidity, which influence the number of bristle filaments that can be picked with the dividing-up indents.

If it only becomes apparent during the use of a dividing-up device that the tolerance specifications cannot be met, a change or a re-fabrication of the dividing-up disc of the dividing-up device is necessary, which is not only time-consuming, but also causes unnecessary costs.

SUMMARY

The object of the invention is therefore to provide a dividing-up device of the type described at the outset, with which these disadvantages can be avoided.

To achieve the object, a dividing-up device of the type described at the outset is proposed, which has at least one of the means and features described herein directed to a dividing-up device. To achieve the object, it is proposed in the case of the dividing-up device described at the outset, in particular, that the dividing-up device comprises an adjusting device, which is designed to adjust the effective indent volume of the at least two dividing-up indents that is available for dividing up clusters of bristles.

The effective indent volume in this case can be the volume of the dividing-up indent which is available when dividing up clusters of bristles from a supply of loose bristle filaments and which ultimately also determines the number of bristle filaments which are placed in the dividing-up indents during a dividing-up process.

With the aid of the adjusting device it is possible to adjust the effective indent volume of the dividing-up indents of the dividing-up disc in dependence on the number of bristle filaments effectively contained in practice in a divided-up cluster of bristles. If is determined, that the divided-up clusters of bristles comprise too small a number of bristle filaments, the effective indent volume of the dividing-up indents can be adjusted accordingly by means of the adjusting device, in particular increased. In exactly the same way it is possible in the reverse case, that is to say if a cluster of bristles divided up with the help of the dividing-up indents comprises too many individual bristle filaments, to reduce the effective indent volume of the dividing-up indents by means of the adjusting device.

By way of the adjusting device of the dividing-up device according to the invention it is thus possible to influence the number of the individual bristle filaments in divided-up clusters of bristles by changing the effective indent volume of the dividing-up indents of the dividing-up disc. In this way, a new fabrication of a dividing-up disc which fails to meet the specifications with regard to the number of picked bristle filaments per divided-up cluster of bristles can be avoided.

In an embodiment of the dividing-up device, it is provided that the adjusting device for adjusting the effective indent volume of the at least two dividing-up indents comprises at least one adjusting means movable relative to the dividing-up indents. The adjusting means can be moved relative to the dividing-up indents in such a way that the position of the adjusting means relative to the at least two dividing-up indents can be used to change the effectively usable indent volume of the dividing-up indents as desired.

In an embodiment of the dividing-up device it is provided that the adjusting device for each dividing-up indent in each case has an adjusting means movable relative to the respective dividing-up indent for adjusting the effective indent volume of the respective dividing-up indent. Preferably, the optionally several adjusting means are then set up for individual adjustment of the effective indent volume of the respective dividing-up indent. For this purpose, the adjusting means can be individually and independently movable relative to the respective dividing-up indent.

With a such adjusting device it is possible to adjust several, preferably all, dividing-up indents of the dividing-up disc of the dividing-up device with regard to their effective indent volume as desired and in particular independently of one another. If the dividing-up device is to be used in a process for dividing up clusters of bristles having different numbers of individual bristle filaments to be divided up, it may be advantageous if the adjusting device is designed, by way of its several adjusting means, to predefine the effective indent volumes of the different dividing-up indents individually. In this way an individual adaptation of the effective indent volumes even of several dividing-up indents, preferably of all dividing-up indents, of the dividing-up disc is possible.

In an embodiment of the dividing-up device it is provided that the at least one adjusting means of the adjusting device is a slider, which, for adjusting the effective indent volume of at least one of the dividing-up indents, is displaceable relative to the at least one dividing-up indent. Here, the at least one slider may be displaceable into and/or against at least one of the dividing-up indents for changing the effective indent volume of the at least one dividing-up indent. The slider or the sliders can be positioned here on the or in the dividing-up indents in such a way that the effective indent volume of the dividing-up indents changes accordingly. In this case, the at least one slider can be designed to be displaced into and/or against the at least one dividing-up indent in particular starting from a center point of the dividing-up disc radially outwardly.

For guiding the at least one slider, the dividing-up disc can have at least one sliding guide for the at least one slider. Here the sliding guide can be formed on or optionally also within the dividing-up disc. If the sliding guide is formed within the dividing-up disc, for example as an inner sliding channel, the sliding guide can be well protected against dirt and/or damage.

The sliding guide can be formed in particular starting from a center point of the dividing-up disc oriented radially outwardly and/or can be designed as linear sliding guide.

The adjusting device can at least have one return means, for example a tension spring, against the restoring force of which the at least one slider for adjustment, in particular for reduction, of the effective indent volume of the at least two dividing-up indents is displaceable relative to the dividing-up indents. Due to its restoring force, the restoring means can prevent play of the slider, which could lead to an imprecise adjustment of the effective indent volume of the dividing-up indents.

In an embodiment of the restoring means it is provided that this applies a restoring force, which is oriented in a radial direction toward a center point of the dividing-up disc.

It is particularly advantageous if the at least one adjusting means for adjusting the effective indent volume of the at least two dividing-up indents is continuously movable. In this way, a continuous, but at least a very fine adjustment of the effective indent volume of the dividing-up indents is possible.

The adjusting device can at least have one displacement mechanism, which is designed for displacing the at least an adjusting means, in particular the at least one already previously mentioned slider, relative to move the at least two dividing-up indents in order to adjust the effective indent volume of the at least two dividing-up indents as desired. For individual adjustment of the indent volume of the individual dividing-up indents, it can be advantageous if the displacement mechanism is designed to individually displace the adjusting means assigned to the respective dividing-up indents.

In an embodiment of the at least one displacement mechanism, this comprises at least one spindle drive with a rotatable spindle and a spindle nut. The spindle nut can be connected via a lever to the at least one adjusting means, in particular to the at least a slider, in order to displace the adjusting means by a rotation of the spindle and a resultant movement, oriented axially in relation to the spindle, of the spindle nut on the spindle relative to at least one dividing-up indent and thus change the effective indent volume of the dividing-up indent and adjust it as desired.

The spindle drive can have an actuator for driving the spindle. In this way the position of the at least one adjusting means relative to at least one dividing-up indent can be easily changed. The actuator can be, for example, a motor and/or also a manually operable rotary handle and/or a handwheel, that is in drive connection to the spindle.

In order to prevent an adjusted position of the at least one adjusting means from changing during movement of the dividing-up disc, the adjusting device can have a locking mechanism, which is designed to lock the at least one adjusting means in its adjusted position. In this context it can be particularly advantageous if the locking mechanism is designed to lock a rotational position of a, for example of the, previously mentioned spindle of a, for example of the, previously mentioned spindle drive of the displacement mechanism. A detachable detent which prevents unintentional movement of the threaded spindle and thus unintentional movement of the adjusting means can serve as a locking mechanism.

The rotatable spindle of the spindle operation can, for example, have a fine thread or a standard thread, so that, depending on the thread, an adjustment to a different degree of fineness of the position of the at least one adjusting means relative to at least one of the at least two dividing-up indents is possible.

In an embodiment of the dividing-up device, it is provided that the adjusting device has an adjusting disc as at least one adjusting means. The adjusting disc can have a number of adjusting indents, in particular at least two adjusting indents, which correspond in terms of number and/or arrangement and/or geometry and/or dimension to the number and/or arrangement and/or geometry and/or dimension of the at least two dividing-up indents of the dividing-up disc. The adjusting disc can thus in particular have at least two adjusting indents. In an embodiment of the dividing-up device it is provided that the adjusting disc and the dividing-up disc of the dividing-up device are formed identically with respect to the at least two dividing-up indents and the at least two adjusting indents. The dividing-up disc and the adjusting disc can be circular discs and/or can have the same diameter.

In a starting position the adjusting indents of the adjusting disc and the dividing-up indents of the dividing-up disc can be brought into overlap. In this relative position of the adjusting disc in relation to the dividing-up disc, the largest possible adjustable effective indent volume of the dividing-up indents can then be predetermined.

If the adjusting disc is moved relative to the dividing-up disc, in particular is rotated about a common axis of rotation of the two discs relative to the dividing-up disc, the dividing-up indents and the adjusting indents initially reach a partial overlap, which leads to a reduction of the effective indent volume of the dividing-up indents. In this way a preferably continuous adjustment of the effective indent volume of the dividing-up indents of the dividing-up disc is possible.

As already previously mentioned, the adjusting disc can be rotatable relative to the dividing-up disc in an embodiment of the dividing-up device. This is effected in particular about a common axis of rotation of the adjusting disc and of the dividing-up disc. The common axis of rotation in this case can run both through a center point of the dividing-up disc and also through a center point of the adjusting disc. The adjusting disc and/or the dividing-up disc can have a circular cross-section, wherein the cross-sections of the adjusting disc and of the dividing-up disc are preferably identical.

In order to change a relative position of the adjusting indents of the adjusting disc relative to the dividing-up indents of the dividing-up disc and thereby adjust an effective indent volume of the dividing-up indents, the adjusting disc can be rotatable relative to the dividing-up disc.

A maximum effective indent volume can be present if the dividing-up indents of the dividing-up disc and the adjusting indents of the adjusting disc are arranged in complete overlap to each other. By way of a displacement of the adjusting indents relative to the dividing-up indents, the effective indent volume of the dividing-up indents can be changed and thus adjusted as desired.

The adjusting device can have an adjusting means, for example an eccentric, for changing a relative rotational position of the dividing-up disc in relation to the adjusting disc. The adjusting means can be part of a displacement mechanism of the adjusting device.

The adjusting means can be rotatably mounted here on the dividing-up disc and can comprise an eccentric cam. The eccentric cam can be guided in a slot of the adjusting disc, preferably oriented in a radial direction on the adjusting disc. With the aid of the eccentric cam and of the slot, a rotational movement of the adjusting means can be converted into a relative rotational movement between dividing-up disc and adjusting disc, and thereby the effective indent volume of the dividing-up indents can be adjusted.

The adjusting device can have at least one setting indicator. The setting indicator can be designed to indicate a setting of the at least one adjusting means and/or to indicate an effective indent volume of at least one of the at least two dividing-up indents. Thus, the adjusted indent volume of the dividing-up indents of the dividing-up disc of the dividing-up device can be recognized, also from a distance.

In one embodiment of the dividing-up device, the dividing-up disc can have at least two dividing-up indents with different sizes, in particular with different widths, and/or with different geometries. With such a dividing-up device, clusters of bristles of different geometry and/or size can be divided from a supply of loose bristle filaments.

The dividing-up device can have a transport device which is designed to transport clusters of bristles held ready in the at least two dividing-up indents to a downstream processing station of a brush-manufacturing machine. Here, the transport device can be designed to transport clusters of bristles by means of negative pressure. In this context it can be advantageous if the transport device has a transport line for each of the dividing-up indents provided on the dividing-up disc, by means of each of which transport lines a cluster of bristles can be removed by means of negative pressure from the respective dividing-up indent and transported to a downstream processing station of a brush-manufacturing machine. The processing station can, for example, be a processing station at which the clusters of bristles are reworked, for example milled and/or ground and/or connected to carrier plates and/or brush bodies.

The dividing-up disc can preferably be designed as a circular disc. To save weight, it is possible for the dividing-up disc to have at least one material-free region.

Lastly, for solving the problem, a brush-manufacturing machine having the features of the independent claim directed to such a brush-manufacturing machine is also proposed. In particular, a brush-manufacturing machine having at least one dividing-up device according to one of the claims directed to such a device is thus proposed for solving the task.

The invention can be summarized as follows:

The invention deals with improvements in the technical field of brush manufacture. For this purpose, among other things, a dividing-up device is proposed which has a dividing-up disc having at least two dividing-up indents formed on its circumference. In order to be able to adjust an effective indent volume of the dividing-up indents as desired, the dividing-up device has an adjusting device which is designed to adjust the effective indent volume of the dividing-up indents available for dividing up clusters of bristles.

BRIEF DESCRIPTION OF THE DRAWINGS

The invention is explained below in greater detail on the basis of exemplary embodiments, but is not limited to these exemplary embodiments. Further exemplary embodiments result from combining the features of individual or of several claims with one another and/or by combining individual or several features of the exemplary embodiments.

In the figures.

DETAILED DESCRIPTION

Figure 1:
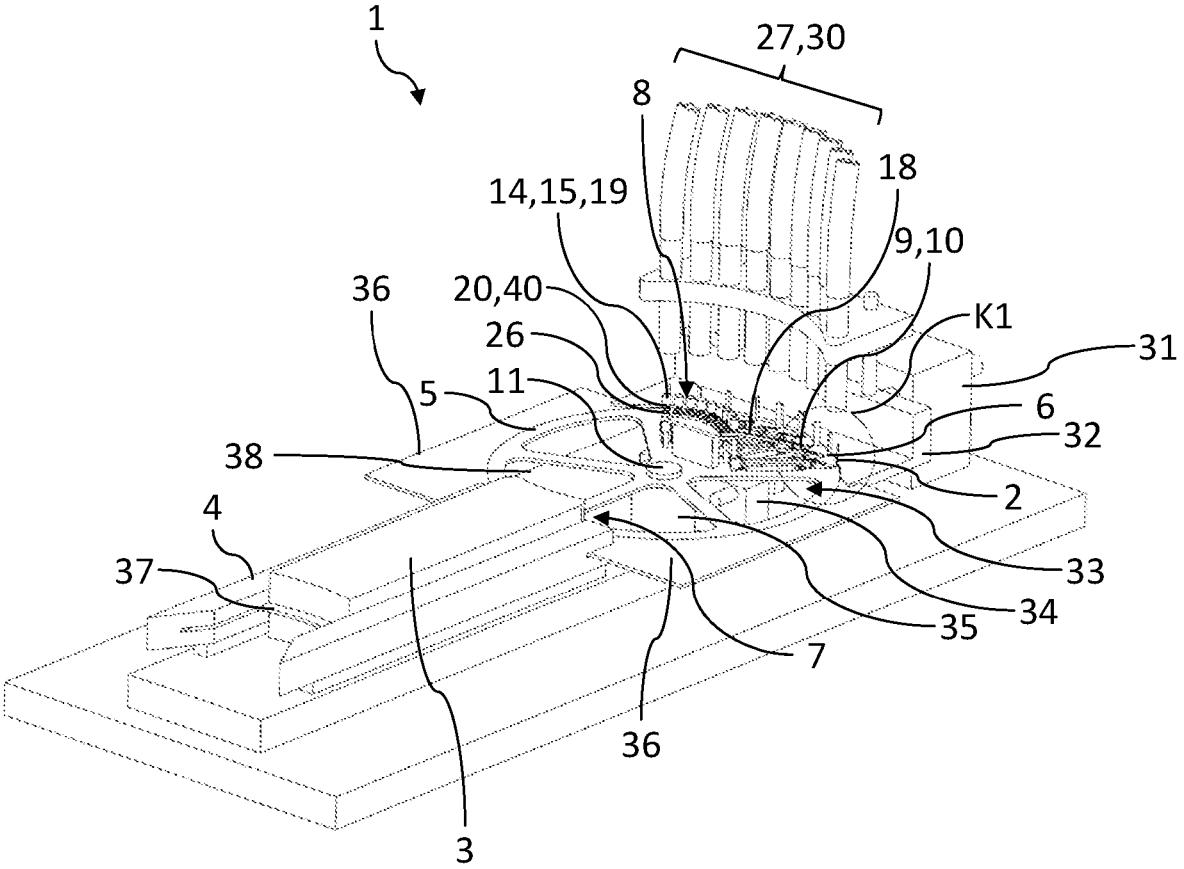
FIG. 1 shows a perspective view of a dividing-up device, which comprises a dividing-up disc with a total of nine dividing-up indents formed on its periphery, wherein the dividing-up device is equipped with an adjusting device for adjusting the effective indent volumes of its dividing-up indents.

In the following description of various embodiments of the invention, elements having the same function are denoted by like reference numbers, even if their design or shaping differs.

FIGS. 1-14 show at least parts of a dividing-up device denoted as a whole by 1, which is designed for dividing up clusters 2 of bristles from a bristle supply 3.

The dividing-up device 1 has a bristle magazine 4 for holding a bristle supply 3 of loose bristle filaments and a dividing-up disc 5. The dividing-up disc 5 has, on its circumference, a plurality of dividing-up indents 6, in the exemplary embodiment shown in the figures a total of nine dividing-up indents 6. The dividing-up disc 5 can be moved with its total of nine dividing-up indents 6 past a removal opening 7 of the bristle magazine 4 for dividing up clusters 2 of bristles from the bristle supply 3 located in the bristle magazine 4.

The dividing-up device 1 has an adjusting device 8, which is designed for setting an indent volume of the dividing-up indents 6 that is effective for dividing up clusters 2 of bristles.

The adjusting device 8, for adjusting the effective indent volume of the dividing-up indents 6, has at least one adjusting means 9, which is movable relative to at least one of the dividing-up indents 6.

FIGS. 1-6 show adjusting means 9 in a first embodiment, while FIGS. 9-13 show an adjusting means 9 in a second embodiment. The indent volumes of the individual dividing-up indents 6 can be individually specified using the adjusting means shown in FIGS. 1-6. The adjusting means 9 shown in FIGS. 9-13 can be used to adjust the indent volumes of the dividing-up indents simultaneously and uniformly.

In the exemplary embodiment of the dividing-up device 1 shown in FIGS. 1-6, the adjusting device 8 for adjusting the effective indent volume of the total of nine dividing-up indents 6 comprises, in each case, an adjusting means 9 in form a slider 10 movable relative to the respective dividing-up indent 6.

The adjusting device 8 in the dividing-up device 1 shown in FIGS. 1-6 is designed for individual adjustment of the effective indent volume of each of the total of 9 dividing-up indents 6.

To adjust the indent volume of the dividing-up indents 6, the sliders 10 can be moved relative to the respective dividing-up indents 6. To adjust the respective indent volume of the individual dividing-up indents 6, the respective slider can be moved starting from a center point 11 of the dividing-up disc 5 radially outwardly into the respective dividing-up indent 6.

Figure 6:
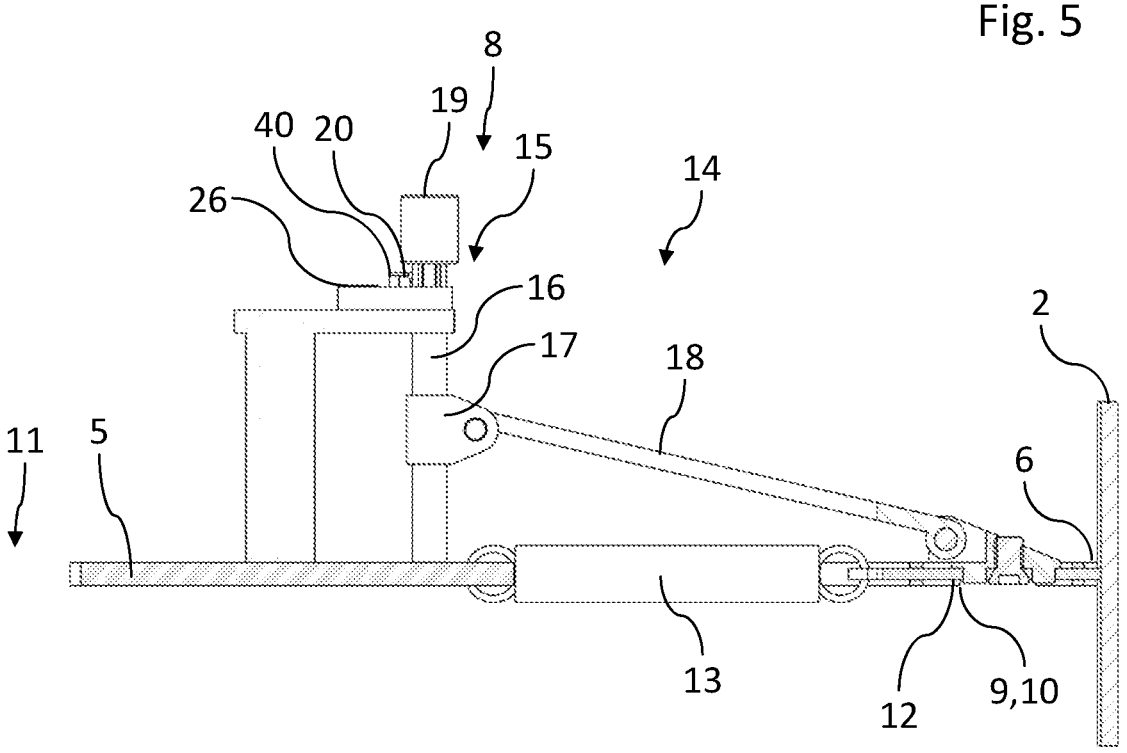
FIG. 6 shows a sectional side view of the functional elements of the dividing-up device shown in FIG. 5.
Figure 7:
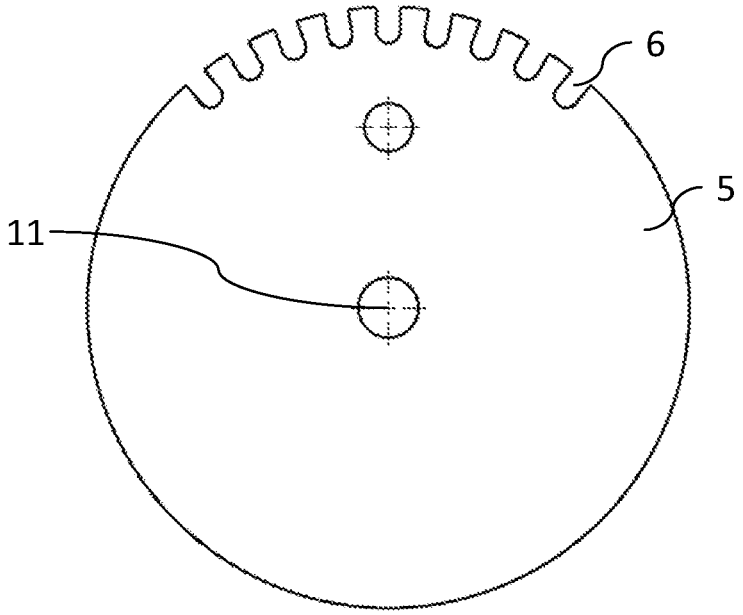
FIG. 7 shows a top view of a further dividing-up disc that can be used on the dividing-up device in the previous figures.

The dividing-up disc 5 has, for each slider 10, in each case a sliding guide 12, which is formed according to the sectional view of the dividing-up disc 5 of FIG. 6 within the dividing-up disc 5. The adjusting device 8 of the dividing-up device 1 shown in FIGS. 1-6 has, for each slider 10, in each case a restoring means 13 in form of a tension spring. The sliders 10, for adjustment, in particular for reduction, of the effective indent volume of the respective dividing-up indent 6, can be displaced relative thereto against the restoring force of the respective restoring means 13 oriented in the radial direction toward the center point 11 of the dividing-up disc 5. The restoring means 13 serve to keep the respective sliders 10 positioned without play, whereby the adjusted effective indent volume of the respective dividing-up indent 6 can be kept constant in each case, even if the dividing-up disc 5 is moved to divide up clusters 2 of bristles.

All of the adjusting means 9 shown in the figures, also the adjusting means 9 shown in FIGS. 9-13, are continuously movable for continuous adjustment of the effective indent volume of the dividing-up indents 6.

The adjusting device 8 has a displacement mechanism 14, which is designed to displace the respective adjusting means 9, in particular if it is formed as slider 10, relative to the individual dividing-up indents 6.

In the exemplary embodiment of the dividing-up device 1 shown in FIGS. 1-6, the displacement mechanism 14 comprises a spindle drive 15. The spindle drive 15 comprises a rotatable spindle 16, which is designed as a threaded spindle, and a spindle nut 17. The spindle nut 17 is connected via a lever 18 to the adjusting means 9, here to the respective slider 10, in order to displace the adjusting means 9 by a rotation of the spindle 16 and a resultant, in respect of the spindle 16, axial movement of the spindle nut 17 relative to the respective dividing-up indent 6.

The lever 18 is articulated here at one end to the spindle nut 17 and at the other end to the adjusting means 9, in particular to the slider 10. In this way the axial movement of the spindle nut 17 on the rotatable spindle 16 of the spindle drive 15 can be converted into a sliding movement of the adjusting means 9, in order to predetermine the effective indent volume of the respective dividing-up indent 6 as desired and, if required, even individually for each dividing-up indent 6.

The spindle drive 15 comprises an actuator 19 for driving the spindle 16. The actuator 19 can be designed as a motor and/or also as a manually operable rotary handle and/or as a manually operable handwheel. The spindle 16 is designed as a threaded spindle and can have a thread of which the pitch is selected depending on the movement range of the adjusting means 9.

It is possible, to equip the spindle 16 for example with a standard thread or also with a fine thread. The adjusting device 8 furthermore has a locking mechanism 20. The locking mechanism 20 is designed to lock the respective adjusting means 9 in its adjusted position, in order to prevent the position of the adjusting means 9 from changing during a movement of the dividing-up disc 5. The locking mechanism 20 shown in the figures is designed for locking, in each case, an adjusted rotational position of the respective spindle 16 of the spindle drives 15. For this purpose, the locking mechanism 20 has pawls 40 that prevent the spindle 16 from continuing to rotate unintentionally.

Each adjusting means 9 shown in FIGS. 1-6 is in each case assigned its own locking mechanism 20. This is advantageous and expedient since each adjusting means 9 can be moved individually relative to the respective dividing-up indent 6 for individual specification of the effective indent volume of the individual dividing-up indents 6.

To save weight, the dividing-up disc 5 according to FIGS. 1 to 6 has material-free regions 38.

FIGS. 7-13 serve to illustrate a further embodiment of an adjusting device 8. The adjusting device 8 shown in these figures has an adjusting disc 21 as at least one adjusting means 9. FIGS. 9-13, which show this adjusting disc 21, illustrate that the adjusting disc 21 has a number of adjusting indents 22, namely nine, which correspond in number, arrangement, geometry and dimension to the dividing-up indents 6 of the dividing-up disc 5.

The adjusting disc 21 has the same diameter as the dividing-up disc 5 and is, exactly like this, circular. The adjusting disc 21 is rotatable relative to the dividing-up disc 5, namely about the same axis of rotation which runs both around the center point 11 of the dividing-up disc 5 and also through the center point 39 of the adjusting disc 21. By way of a relative rotation of the adjusting disc 21 in relation to the dividing-up disc 5, a relative position of the adjusting indents 22 in relation to the dividing-up indents of the dividing-up disc 5 can be changed and thereby the effective indent volumes of the dividing-up indents 6 can be adjusted. This becomes clear from a comparison of FIGS. 10-13, which show the adjusting disc 21 below the dividing-up disc 5 in different relative rotational positions in relation to the dividing-up disc 5.

For changing a relative rotary position of the dividing-up disc 5 in relation to the adjusting disc 21, the adjusting device 8 comprises a control means 23, which here is designed as an eccentric and is part of a displacement mechanism 14 of the adjusting device 8 of this exemplary embodiment.

Figure 8:
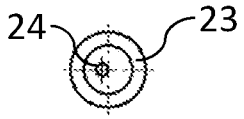
FIG. 8 shows a bottom view of a control means in the form of an eccentric, with which a relative position of the adjusting disc shown in FIG. 9 in relation to the dividing-up disc shown in FIG. 7 is changeable.
Figure 9:
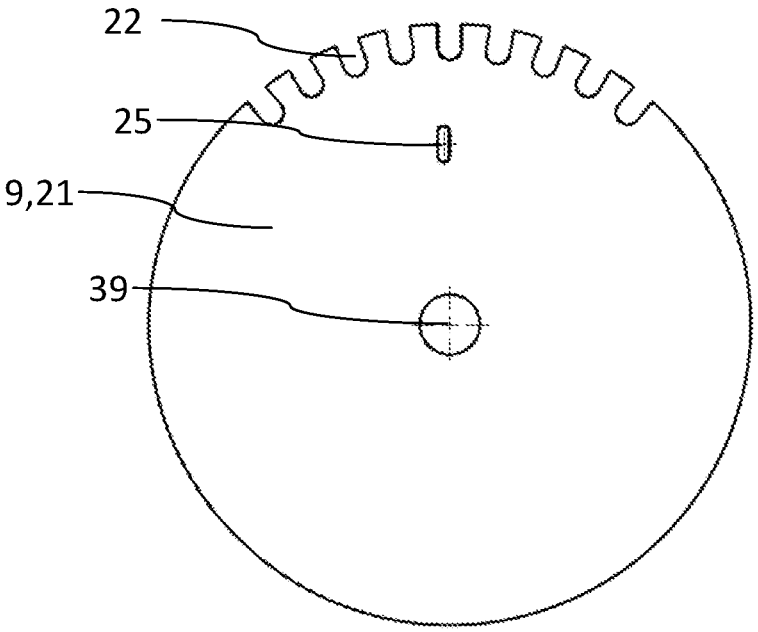
FIG. 9 shows a top view of an adjusting disc which, with regard to its adjusting indents, is identical to the dividing-up indents of the dividing-up disc shown in in FIG. 7 and serves as adjusting means of the adjusting device of a dividing-up device in the sense of the invention.

The control means 23 is shown in FIG. 8 and rotatably mounted on the dividing-up disc 5. The control means 23 has an eccentric cam 24, which is guided in a slot 25 of the adjusting disc 21, said slot being oriented in the radial direction on the adjusting disc 21, in order to convert a rotational movement of the adjusting means 23 into a relative rotational movement of the adjusting disc 21 in relation to the dividing-up disc 5.

Figure 10:
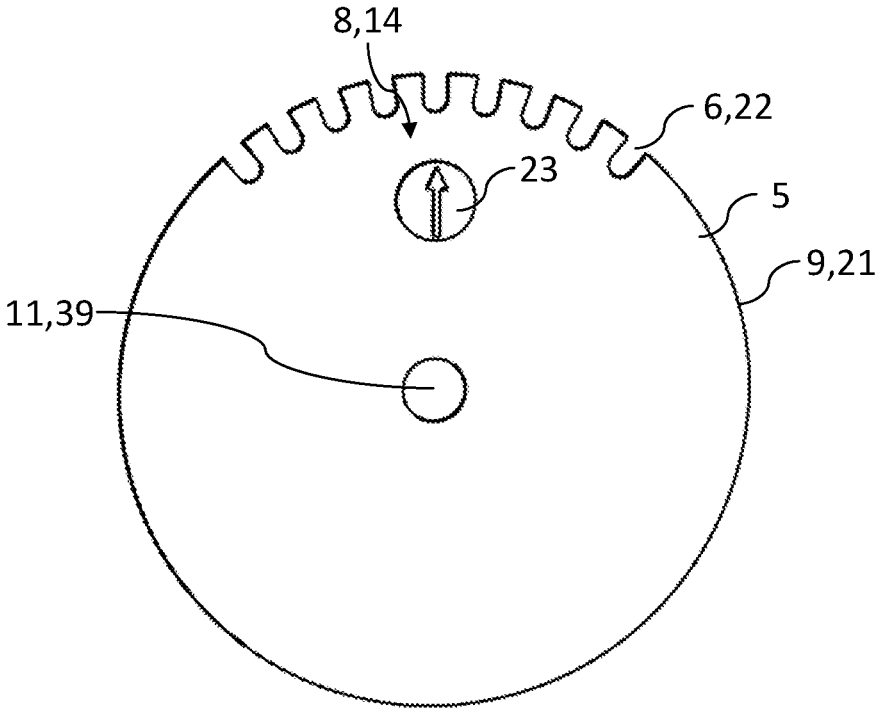
FIG. 10 shows a top view of the dividing-up disc from FIG. 7 and the adjusting disc from FIG. 9 arranged in complete overlap, wherein the eccentric from FIG. 8 is rotatably mounted on the dividing-up disc and is arranged in a position in which it holds the adjusting disc relative to the dividing-up disc arranged in such a position that the adjusting indents and the dividing-up indents are arranged in complete overlap relative to one another, so that a maximum effective indent volume of the dividing-up indents is available.
Figure 11:
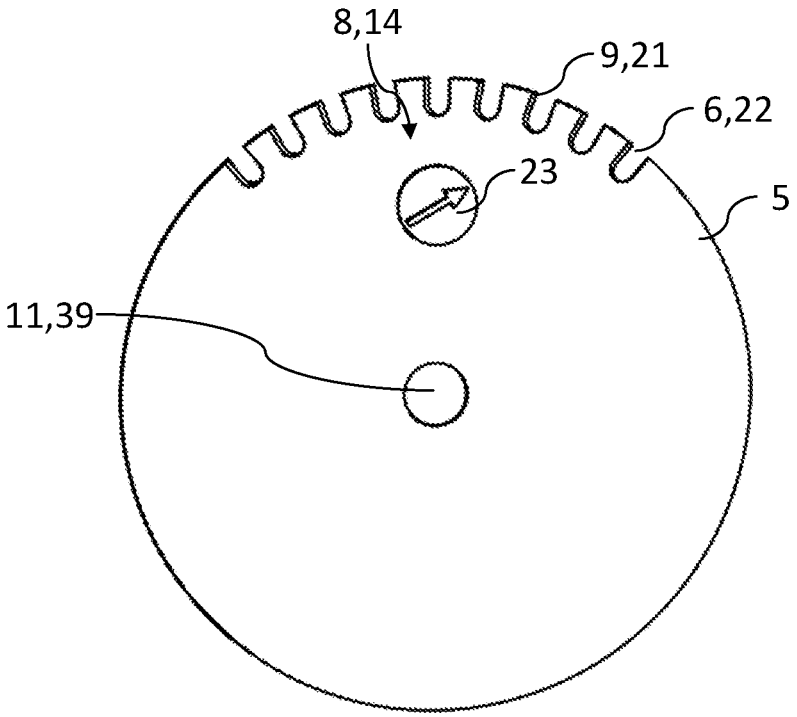
FIGS. 11-13 show the two discs shown in FIG. 10 in different relative rotational positions in relation to each other to illustrate the possibilities for adjusting the effective indent volume of the dividing-up indents of the dividing-up disc.
Figure 12:
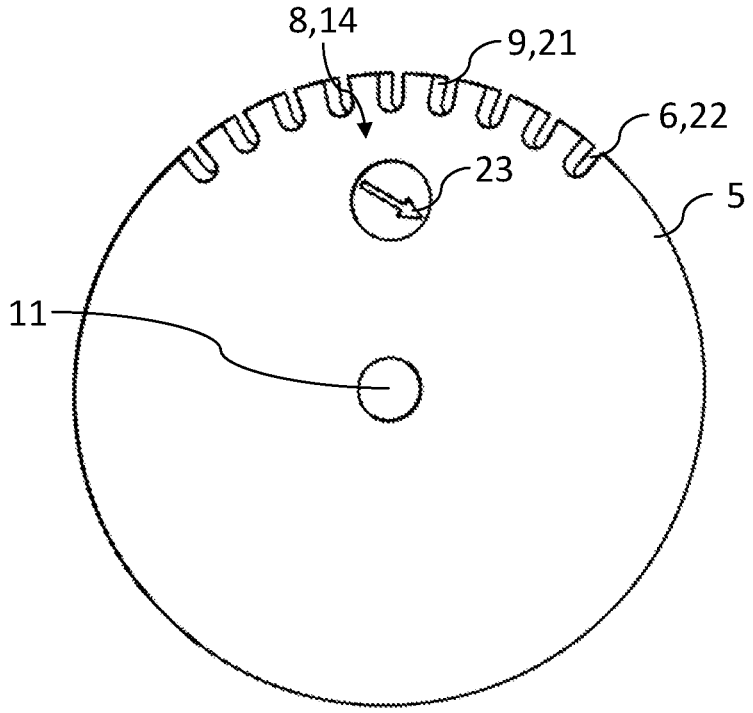
Figure 13:
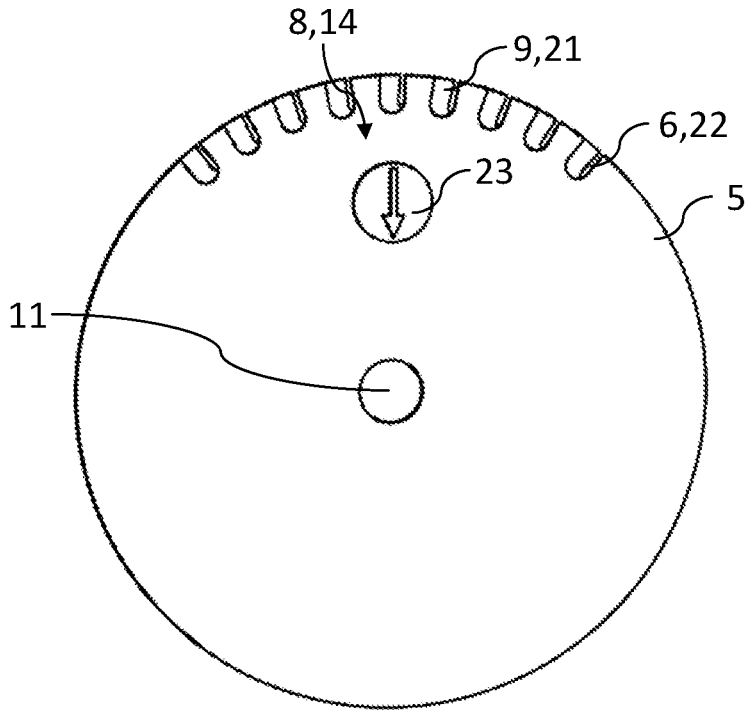
Figure 14:
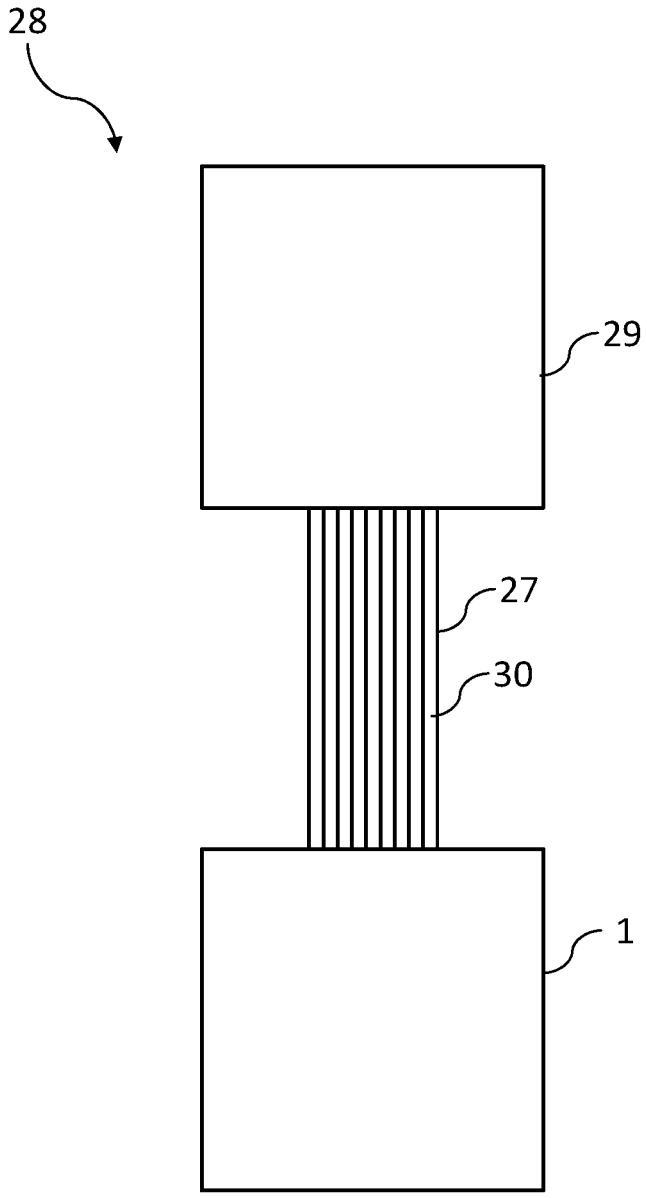
FIG. 14 shows a schematic view of a brush-manufacturing machine comprising a processing station and a dividing-up device.

The arrow superimposed on the control means 23 in each of the illustrations in FIGS. 10-13 illustrates the position of the eccentric cam 24 and the resultant rotational position of the adjusting disc 21 relative to the dividing-up disc 5. FIG. 10 shows the dividing-up indents 6 with their maximum effective indent volume. Due to the change of the relative position of the adjusting disc 21 relative to the dividing-up disc 5, the respective effective indent volume of the dividing-up indents 6 according to the situations shown in the FIGS. 11 and 12 reduces to a minimum, as shown in FIG. 13.

FIGS. 1-6 illustrate that the adjusting device 8 of the dividing-up device 1 illustrated there for each adjusting means 9 in each case has a setting indicator 26, which is designed to indicate the respective setting of the respective adjusting means 9 and thereby to indicate the respective set effective indent volume of the respective dividing-up indent 6.

The dividing-up disc 5 of the dividing-up device 1 shown in FIGS. 1-6 has dividing-up indents 6 which differ from one another in terms of their size, namely their width, and/or in terms of their geometry. This can be seen in particular in FIG. 2. There, it can be seen that the uppermost dividing-up indent 6 in the detailed view has a greater width than the other dividing-up indents 6 shown in the detailed view of FIG. 2.

The dividing-up device shown in the FIGS. 1-6 further comprises a transport device 27, which is designed for transporting the clusters 2 of bristles, held ready in the dividing-up indents 6, to a downstream processing station 29 of a brush-manufacturing machine 28. The transport device 27 is designed according to FIG. 14 for transport of the clusters 2 of bristles to the downstream processing station 29 of the brush-manufacturing machine 28 by means of negative pressure. For this purpose the transport device 27 has a total of 9 transport lines 30, with the aid of which the clusters 2 of bristles can be removed from the dividing-up indents 6 and transported to the processing station 29 of the brush-manufacturing machine 28.

The processing station 29 can, for example, be a processing station at which the clusters 2 of bristles are reworked, for example milled and/or ground and/or connected to carrier plates and/or brush bodies of brushes to be manufactured.

According to FIGS. 1-6, the dividing-up device 1 further comprises a counter-holding device 31, which has a movable counter-holder 32, which is assigned to the dividing-up disc 5.

Figure 2:
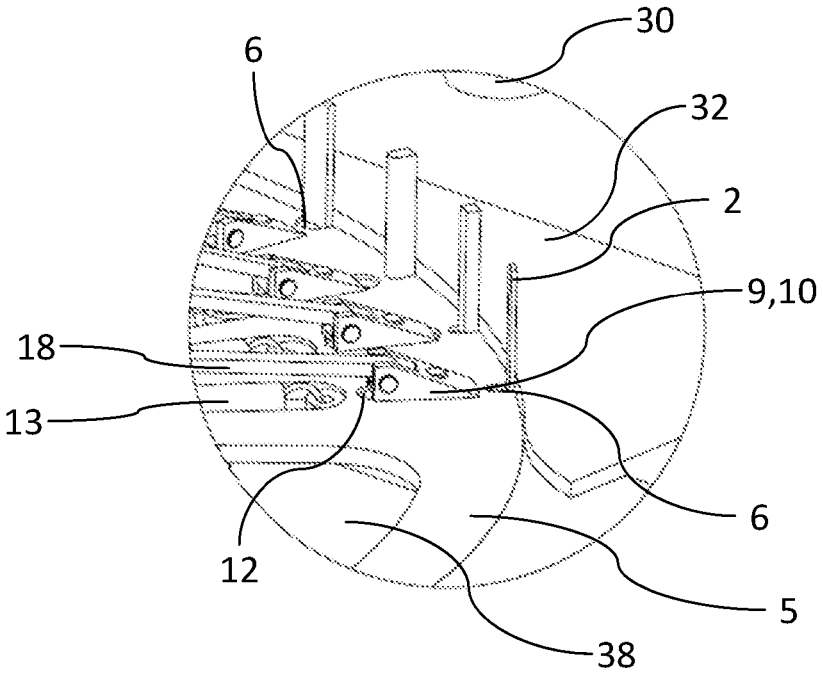
FIG. 2 shows the detail marked in FIG. 1 with the circle K1 in an enlarged representation, wherein it can be seen that the adjusting means of the adjusting device assigned to each dividing-up indent are in each case inserted into the respective dividing-up indents to different extents, such that each of the dividing-up indents has a different effective indent volume.
Figure 3:
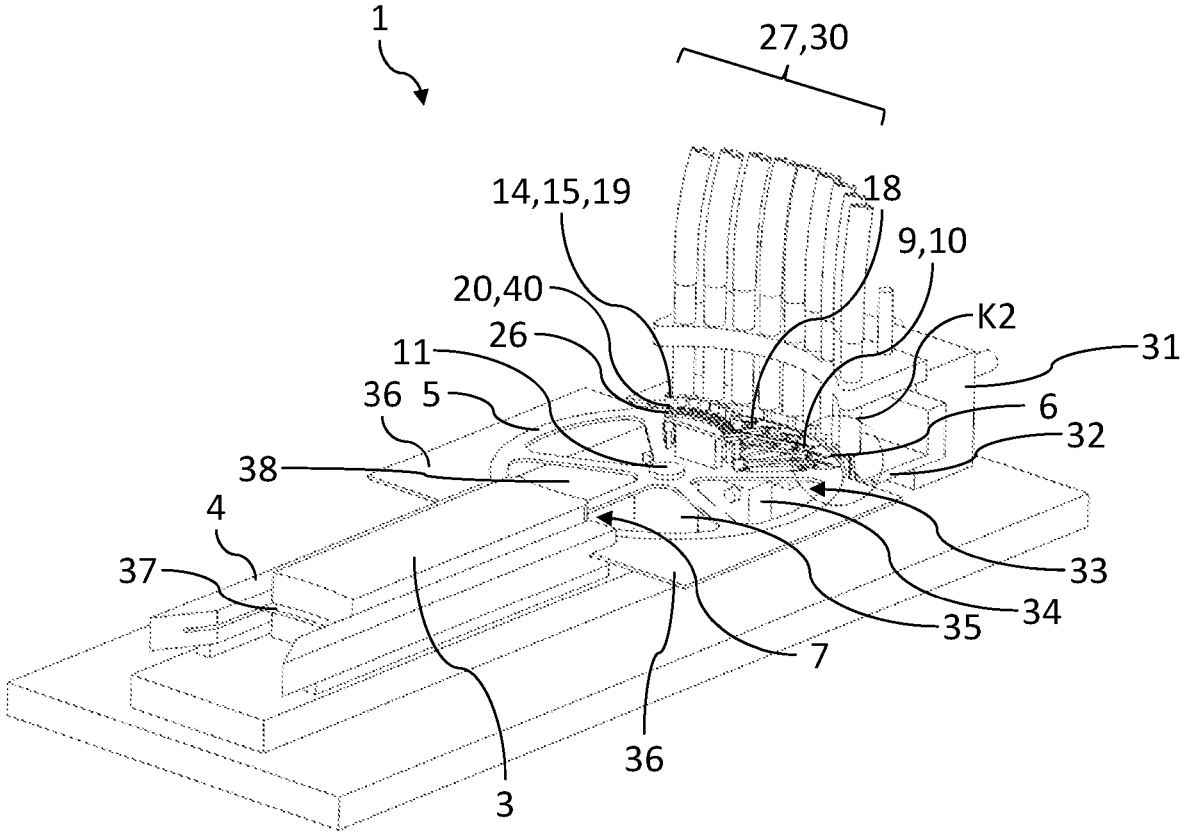
FIG. 3 shows the dividing-up device shown in FIG. 1, wherein here the individual clusters of bristles are already removed from the dividing-up indents of the dividing-up disc by means of a transport device of the dividing-up device.
Figure 4:
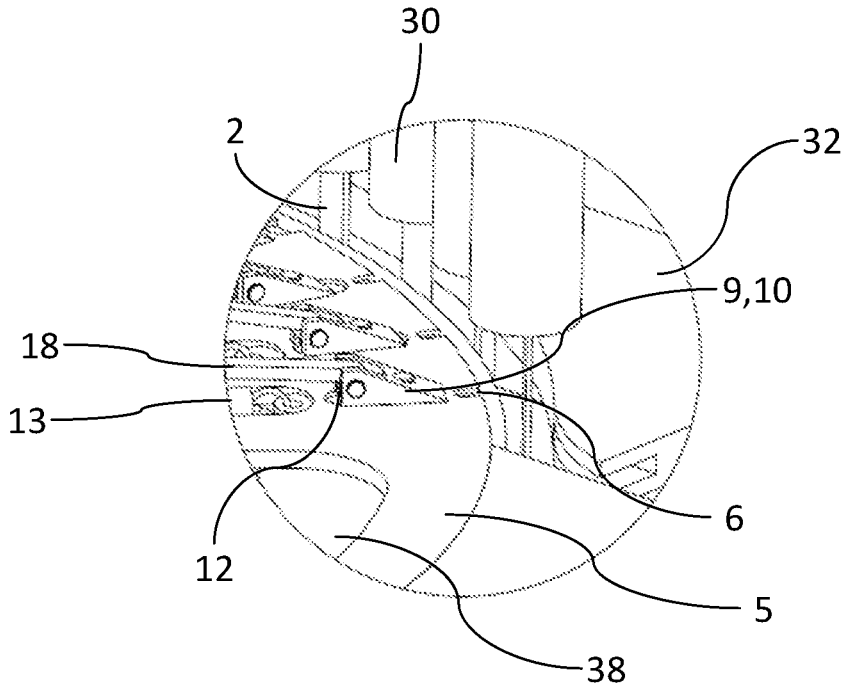
FIG. 4 shows the detail marked in FIG. 3 with the circle K2 in an enlarged representation.
Figure 5:
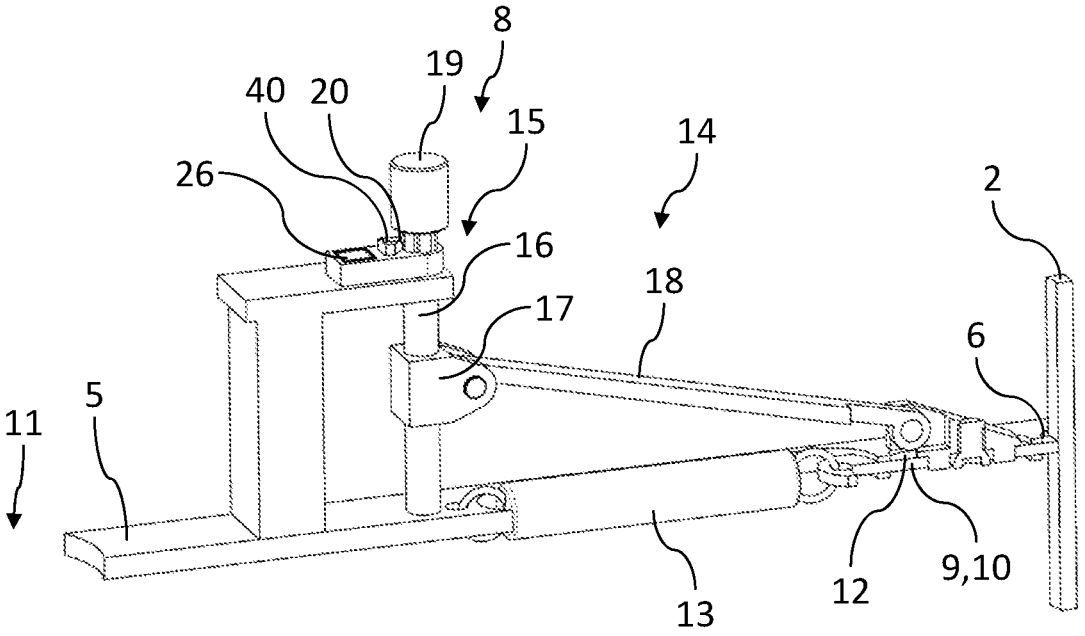
FIG. 5 shows a representation of the dividing-up disc of the dividing-up device shown in the previous figures, in isolation and partially cut in the edge region, wherein functional elements of the adjusting device can be seen on an upper flat side of the dividing-up disc.

The counter-holder 32 can be moved from the position shown in FIGS. 1 and 2, in which it has been approached toward the dividing-up disc 5, into the spaced-apart position shown in the FIGS. 3 and 4, in which the dividing-up indents 6 and clusters 2 of bristles positioned therein are released in order to be transported away with the aid of the transport device 27. Each of the total of nine dividing-up indents 6 of the dividing-up device 1 shown in FIGS. 1-6 is assigned in each case a cluster pusher 33 of a pusher device 34, by which the clusters 2 of bristles located in the dividing-up indents 6 can be pushed out radially outwardly from the dividing-up indents 6 by means of the transport device 27 in order to be transported away.

The dividing-up device 1 further comprises a rotary drive 35, with which the dividing-up disc 5 can be set into rotation in order to divide up the clusters 2 of bristles from the bristle magazine 4. In order to secure the divided-up clusters 2 of bristles on their path from the bristle magazine 4 to a transfer position located at the transport device 27, the dividing-up device 1 also has counterparts 36, which pick up the outer contour of the dividing-up disc 5 and are assigned to the dividing-up disc 5. The counterparts 36 have, at their flanks assigned to the dividing-up disc 5, in each case a circular-arc-shaped contour, serving to secure the clusters 2 of bristles in the dividing-up indents during a movement of the dividing-up disc relative to the counterparts 36.

In order to be able to push the bristle supply 3 located in the bristle magazine 4 against the dividing-up disc 5, the dividing-up device 1 has a corresponding material pusher 37, with which a corresponding pressure can be applied to the bristle supply 3 arranged in the bristle magazine 4. This favors the reliable and uniform removal of clusters 2 of bristles from the bristle supply 3 of the bristle magazine 4 with the aid of the dividing-up disc 5.

LIST OF REFERENCE SIGNS

1 dividing-up device
2 cluster of bristles
3 bristle supply
4 bristle magazine
5 dividing-up disc
6 dividing-up indent
7 removal opening
8 adjusting device
9 adjusting means
10 slider
11 center point of 5
12 sliding guide
13 restoring means
14 displacement mechanism
15 spindle drive
16 spindle
17 spindle nut
18 lever
19 actuator
20 locking mechanism
21 adjusting disc
22 adjusting indent
23 control means
24 eccentric cam
25 slot
26 setting indicator
27 transport device
28 brush-manufacturing machine
29 processing station
30 transport line
31 counter-holding device
32 counter-holder
33 cluster pusher
34 pusher device
35 rotary drive
36 counterpart
37 material pusher
38 material-free region in 5
39 center point of 21
40 pawl

The invention claimed is:

1. A dividing-up device (1) for dividing up clusters (2) of bristles from a bristle supply (3), the dividing-up device (1) comprises:

a bristle magazine (4) for receiving a bristle supply (3);

a dividing-up disc (5) comprising dividing-up indents (6) on a circumference thereof, the dividing-up disc (5) being movable with the dividing-up indents (6) past a removal opening (7) of the bristle magazine (4) for dividing up clusters (2) of bristles from the bristle supply (3) located in the bristle magazine (4); and an adjusting device (8), which is designed to adjust an effective indent volume of the dividing-up indents (6) that is available for dividing up of the clusters (2) of bristles;

wherein the adjusting device (8) for adjusting the effective indent volume of the dividing-up indents (6) comprises at least one adjuster that is movable relative to at least one of the dividing-up indents (6) and at least one displacement mechanism (14) which is designed to displace the at least one adjuster relative to the at least one of the dividing-up indents (6); and wherein the at least one displacement mechanism (14) comprises a spindle drive (15) with a rotatable spindle (16) and a spindle nut (17), the spindle nut (17) is connected via a lever (18) to the at least one adjuster in order to displace the at least one adjuster, by a rotation of the spindle (16) and a resultant axial movement of the spindle nut (17) with respect to the spindle (16), relative to at least one of the dividing-up indents (6).

2. The dividing-up device (1) as claimed in claim 1, wherein the adjusting device (8) for each of the dividing-up indents (6) has a slider (10) that is movable relative to the respective dividing-up indent (6), for adjusting the effective indent volume of the respective dividing-up indent (6).

3. The dividing-up device (1) as claimed in claim 1, wherein the at least one adjuster is a slider (10) which is displaceable relative to at least one of the dividing-up indents (6) for adjusting the effective indent volume of the at least one of the dividing-up indents (6), and the slider (10) is displaceable at least one of into or against the at least one of the dividing-up indents (6) for adjusting the effective indent volume of the at least one of the dividing-up indents (6), radially outwardly starting from a center point (11) of the dividing-up disc (5).

4. The dividing-up device (1) as claimed in claim 3, wherein the dividing-up disc (5) has at least one sliding guide (12) for the at least one slider (10).

5. The dividing-up device (1) as claimed in claim 3, wherein the adjusting device (8) comprises at least one restoring element (13), against a restoring force of which, the at least one slider (10) is displaceable for adjusting the effective indent volume of the at least one of the dividing-up indents (6).

6. The dividing-up device (1) as claimed in claim 1, wherein the spindle drive (15) comprises an actuator (19) for driving the spindle (16).

7. The dividing-up device (1) as claimed in claim 1, wherein the adjusting device (8) comprises a locking mechanism (20) which is designed to lock the at least one adjuster in an adjusted position thereof, and the locking mechanism (20) is designed to lock a rotational position of the spindle (16) of the spindle drive (15).

8. The dividing-up device (1) as claimed in claim 1, wherein the at least one adjuster is continuously movable.

9. The dividing-up device (1) as claimed in claim 1, wherein the adjusting device (8) has at least one setting indicator (26) which is designed to display at least one of a setting of the at least one adjuster or to an adjusted effective indent volume of the at least one of the dividing-up indents (6).

10. The dividing-up device (1) as claimed in claim 1, wherein the dividing-up disc (5) has at least two of the dividing-up indents (6) having different sizes.

11. The dividing-up device (1) as claimed in claim 1, further comprising a transport device (27) which is designed to transport the clusters (2) of bristles held ready in the dividing-up indents (6) to a downstream processing station (29) of a brush-manufacturing machine (28).

12. A brush-manufacturing machine (28) comprising at least one of the dividing-up devices (1) as claimed in claim 1.

13. A dividing-up device (1) for dividing up clusters (2) of bristles from a bristle supply (3), the dividing-up device (1) comprises:

a bristle magazine (4) for receiving a bristle supply (3);

a dividing-up disc (5) comprising dividing-up indents (6) on a circumference thereof, the dividing-up disc (5) being movable with the dividing-up indents (6) past a removal opening (7) of the bristle magazine (4) for dividing up clusters (2) of bristles from the bristle supply (3) located in the bristle magazine (4); and an adjusting device (8), which is designed to adjust an effective indent volume of the dividing-up indents (6) that is available for dividing up of the clusters (2) of bristles;

wherein the adjuster comprises, an adjusting disc (21) which has a number of adjusting indents (22) which corresponds in at least one of a number, arrangement, geometry, or dimension to a corresponding at least one of a number, arrangement, geometry, or dimension of the dividing-up indents (6) of the dividing-up disc (5).

14. The dividing-up device (1) as claimed in claim 13, wherein the adjusting disc (21) is rotatable relative to the dividing-up disc (5) in order to change a relative position of the adjusting indents (22) to the dividing-up indents (6) of the dividing-up disc (5) and thereby adjust the effective indent volume of the dividing-up indents (6).

15. The dividing-up device (1) as claimed in claim 14, wherein the adjusting device (8) comprises a control device for changing a relative rotational position of the dividing-up disc (5) with respect to the adjusting disc (21), and the control device is part of a, displacement mechanism (14).

16. The dividing-up device (1) as claimed in claim 15, wherein the control device is rotatably mounted on the dividing-up disc (5) and an eccentric cam (24) of the control device is guided in a slot (25) of the adjusting disc (21) in order to convert a rotary movement of the control device into a rotary movement of the adjusting disc (21) relative to the dividing-up disc (5).

* * * * *